US008139015B2

(12) United States Patent
Kawaguchi et al.

(10) Patent No.: US 8,139,015 B2
(45) Date of Patent: Mar. 20, 2012

(54) AMPLIFICATION CIRCUIT, DRIVER CIRCUIT FOR DISPLAY, AND DISPLAY

(75) Inventors: Keiko Kawaguchi, Nagasaki (JP); Koji Tsukamoto, Nagasaki (JP)

(73) Assignee: Sony Corporation, Tokyo (JP)

( * ) Notice: Subject to any disclaimer, the term of this patent is extended or adjusted under 35 U.S.C. 154(b) by 1124 days.

(21) Appl. No.: 11/611,261

(22) Filed: Dec. 15, 2006

(65) Prior Publication Data

US 2007/0139350 A1 Jun. 21, 2007

(30) Foreign Application Priority Data

Dec. 19, 2005 (JP) ..... P2005-364232

(51) Int. Cl.
*G09G 3/36* (2006.01)

(52) U.S. Cl. ..... 345/100; 330/255; 330/260

(58) Field of Classification Search ..... 345/100; 330/225, 292, 255, 260
See application file for complete search history.

(56) References Cited

U.S. PATENT DOCUMENTS

| | | | | |
|---|---|---|---|---|
| 4,389,620 | A * | 6/1983 | Yamaguchi | 330/304 |
| 6,359,512 | B1 * | 3/2002 | Ivanov et al. | 330/255 |
| 6,437,645 | B1 * | 8/2002 | Ivanov et al. | 330/255 |
| 6,784,500 | B2 * | 8/2004 | Lemkin | 257/368 |
| 7,019,730 | B2 * | 3/2006 | Tsuchiya | 345/98 |
| 2002/0109547 | A1 * | 8/2002 | Ivanov et al. | 330/255 |
| 2003/0151570 | A1 * | 8/2003 | LeChevalier et al. | 345/84 |
| 2003/0156101 | A1 * | 8/2003 | LeChevalier | 345/204 |
| 2003/0160749 | A1 * | 8/2003 | Tsuchi | 345/87 |
| 2004/0085086 | A1 * | 5/2004 | LeChevalier | 324/770 |
| 2005/0040889 | A1 * | 2/2005 | Tsuchi | 330/255 |
| 2005/0285676 | A1 * | 12/2005 | Jones | 330/255 |
| 2006/0050065 | A1 * | 3/2006 | Maki | 345/204 |

FOREIGN PATENT DOCUMENTS

| | | |
|---|---|---|
| JP | 03-154412 | 7/1991 |
| JP | 04-356816 | 12/1992 |
| JP | 11-136044 | 5/1999 |
| JP | 2001-042287 | 2/2001 |
| JP | 2001-326542 | 11/2001 |
| JP | 2002-280845 | 9/2002 |
| JP | 2004-140487 | 5/2004 |
| JP | 2006-157607 | 6/2006 |

OTHER PUBLICATIONS

Solomon, "The Monolithic Op Amp: A Tutorial Study", Dec. 1974, IEEE Journal of Solid State Circuits, vol. SC-9, No. 6, pp. 314-332.*
Office Action date issued Apr. 27, 2010 in Japanese Application No. 2005-364232.

* cited by examiner

*Primary Examiner* — Richard Hjerpe
*Assistant Examiner* — Dorothy Harris
(74) *Attorney, Agent, or Firm* — SNR Denton US LLP

(57) ABSTRACT

An amplification circuit includes: an amplifier apparatus configured to amplify an input signal and outputting the amplified signal from an output terminal; and a boost circuit which, when a difference between a voltage of the input signal and a voltage at the output terminal is greater than a given value, supplies a positive or negative constant electrical current to at least one given part of the amplifier apparatus, thus enhancing output responsiveness of the amplifier apparatus.

14 Claims, 8 Drawing Sheets

AMPLIFICATION CIRCUIT, DRIVER CIRCUIT FOR DISPLAY, AND DISPLAY

CROSS REFERENCES TO RELATED APPLICATIONS

The present invention contains subject matter related to Japanese Patent Application JP2005-364232 filed in the Japanese Patent Office on Dec. 19, 2005, the entire contents of which being incorporated herein by reference.

BACKGROUND OF THE INVENTION

1. Field of the Invention

The present invention relates to an amplification circuit, to a driver circuit for a display, and to a display. More particularly, the invention relates to an amplification circuit that can be used in a driver circuit for a display. The invention also relates to a driver circuit incorporating the amplification circuit. Furthermore, the invention relates to a display using the driver circuit.

2. Description of the Related Art

In recent years, plasma display panels (PDPs) and liquid crystal divice (LCDs) have become widespread as display devices. Since these liquid crystal displays have features of thinness, lightweightness, and low power consumption, the LCDs are increasingly used especially in so-called mobile terminals such as cell phones, PDAs (personal digital assistances) notebook computers, and portable TV units.

Furthermore, development of large-sized liquid crystal displays is in progress. Applications to non-portable large-screen displays and large-screen TV sets are on the rise.

Of these liquid crystal displays, active-matrix-driven displays which have excellent response speed and image quality and permit high-definition display have become the mainstream. Nonlinear devices such as transistors or diodes are used at each pixel of the display portion of this type of liquid crystal display. An image is displayed on the display portion by activating these devices.

More specifically, the liquid crystal display has a semiconductor substrate and a counter substrate mounted opposite to each other. Transparent pixel electrodes and thin-film transistors (TFTs) are arranged on the semiconductor substrate. One transparent electrode is formed on the whole display portion of the counter substrate. A liquid crystal material is sealed between the two substrates. A voltage corresponding to a pixel gray level is applied to each pixel electrode to produce a voltage difference between each pixel electrode and the electrode of the counter substrate by controlling the TFTs having a switching function. In this way, the transmittance of the liquid crystal material is varied, and an image is displayed.

Plural data lines for applying voltages (hereinafter referred to as the gray level voltages) corresponding to gray levels to the pixel electrodes are arranged on the semiconductor substrate. Scanning lines for applying control signals for turning on and off the TFTs are arranged also on the semiconductor substrate. Application of the gray level voltage to the pixel electrodes is done via the data lines. An image is displayed on the display portion of the LCD by applying gray level voltages to all the pixel electrodes connected to the data lines during one frame period for image display.

The data lines provide large capacitive load due to the capacitance of the liquid crystal material sandwiched between the opposite substrate electrodes and due to capacitance produced at the intersections of scanning lines when viewed from the driver circuit (hereinafter may also be referred to as the source driver) for applying the gray level voltages.

Therefore, a driver circuit for driving these data lines is required to drive the data lines having large capacitive load at high voltage accuracy and at high speed. To satisfy this requirement, various data line driver circuits have been developed (see, for example, JP-A-2001-42287 (patent reference 1)).

An example of such a data line driver circuit is hereinafter described in detail by referring to a drawing. Higher accuracy and higher speed are imparted to this data line driver circuit by an operational amplifier 100 used as an output amplifier. FIG. 8 schematically shows the configuration of the operational amplifier 100 used as the output amplification circuit of the data line driver circuit.

As shown in FIG. 8, the operational amplifier (op amp) 100 is a voltage follower operational amplifier apparatus including a differential amplifier 110 and an output amplifier 120. This operational amplifier apparatus 100 outputs a voltage its output terminal Vo, the voltage being equal to the voltage at its input terminal Vin.

The differential amplifier 110 includes a constant current circuit I100, PMOS transistors T100 and T101 having the same characteristics, and NMOS transistors T102, T103 having the same characteristics.

The constant current circuit I100 is connected between a first potential (Vcc in this example) and the common source of the PMOS transistors T100, T101. The sources of the PMOS transistors T100 and T101 are connected together.

The gate of the PMOS transistor T100 is connected to the input terminal Vin, while the drain is connected to the drain of the NMOS transistor T102. The drain of the PMOS transistor T101 is connected to the drain of the NMOS transistor T103, whereas the gate is connected to the output terminal Vo.

The sources of the NMOS transistors T102 and T103 are both connected to a second potential (GND in this example). The gates of the NMOS transistors T102 and T103 are both connected to the drain of the NMOS transistor T103.

Meanwhile, the output amplifier 120 includes a constant current circuit I101, an NMOS transistor T105, and a capacitive device C100.

The constant current circuit I101 is connected between the first potential and the output terminal Vo. The drain of the NMOS transistor T105 is connected to the output terminal Vo, whereas the source is connected to the second potential. The gate of the NMOS transistor T105 is connected to the drain of the PMOS transistor T100 and to the drain of the NMOS transistor T102. The capacitive device C100 is mounted as a capacitor for providing phase compensation, and is connected between the drain and gate of the NMOS transistor T105.

Let I100 be the current limited by the constant current circuit I100. Let I101 be the current limited by the constant current circuit I101. It is assumed that a data line having a capacitive load is connected to the output terminal Vo.

In this way, in the operational amplifier apparatus 100, the voltage at the output terminal Vo is fed back to the differential amplifier 110, i.e., applied to the gate of the PMOS transistor T101. The operational amplifier apparatus 100 has a voltage amplification factor of 1, and forms a voltage follower having high current supply capabilities. The operation of the operational amplifier apparatus 100 designed in this way is described in detail below.

When the voltage at the output terminal Vo of the op amp apparatus 100 is lower than the voltage at the input terminal Vin, the gate voltage of the NMOS transistor T105 is lowered, turning off the NMOS transistor T105 temporarily. Consequently, the voltage at the output terminal Vo is pulled up by the current I101 from the constant current circuit I101.

Meanwhile, when the voltage at the output terminal Vo is higher than the voltage at the input terminal Vin, the gate voltage of the NMOS transistor T105 is pulled up. The voltage at the output terminal Vo is pulled down by the NMOS transistor T105. At this time, the PMOS transistors T100 and T101 act in such a way that the electrical current flowing between the source and drain of T100 is equal to the electrical current flowing between the source and drain of T101 and so the voltage at the output terminal Vo quickly converges to the voltage level at the input terminal Vin while attenuating.

In this way, in the operational amplifier apparatus 100, even where an input signal is applied to the input terminal Vin while switching the gray level voltage for the pixels sequentially, data lines connected to the output terminal Vo and having capacitive load can be driven at high speed by a gray level voltage at high voltage accuracy and with high current supply capabilities.

SUMMARY OF THE INVENTION

The rate at which the aforementioned operational amplifier is driven, i.e., the slew rate of the operational amplifier, improves in proportion to increase in the value of the current supplied into the differential amplifier 110 and decreases in proportion to increase in the capacitance value of the phase compensating capacitor. Therefore, in order to improve the slew rate such that the output to the data lines having capacitive load can be outputted while quickly switching the gray level voltage, it is necessary to increase the current fed into the differential amplifier 110 or to reduce the capacitance value of the phase compensating capacitor.

However, if the value of the current fed into the differential amplifier 110 is increased, the power consumption increases. On the other hand, if the capacitance value of the phase compensating capacitor is reduced, the stability of the operational amplifier 100 deteriorates.

In view of the above, it is desirable to provide an amplification circuit which shows suppressed power consumption and whose stability is not impaired.

A first embodiment of the invention provides a an amplification circuit including: an amplifier apparatus configured to amplify an input signal and outputting the amplified signal from an output terminal and a boost circuit which supplies a positive or negative electrical current to at least one given portion of the amplifier apparatus when the difference between the voltage of the input signal and the voltage at the output terminal is greater than a given value, to enhance the output responsiveness of the amplifier apparatus.

A second embodiment of the invention provides a driver circuit for a liquid crystal display. The driver circuit outputs a driver signal for driving each pixel formed in the display portion of the LCD that displays an image. The driver circuit has an amplifier apparatus configured to amplify an input signal and outputting the amplified signal from an output terminal and a boost circuit which, when the difference between the voltage of the input signal and the voltage at the output terminal is greater than a given value, supplies a positive or negative constant electrical current to at least one given portion of the amplifier apparatus, thus enhancing the output responsiveness of the amplifier apparatus.

A third embodiment of the invention provides a display device having a driver circuit for outputting a driver signal for driving each pixel formed in a display portion. The driver circuit has an amplifier apparatus configured to amplify an input signal and outputting the amplified signal from an output terminal and a boost circuit which, when the difference between the voltage of the input signal and the voltage at the output terminal is greater than a given value, supplies a positive or negative or constant electrical current to at least one given portion of the amplifier apparatus, thereby enhancing the output responsiveness of the amplifier apparatus.

A fourth embodiment of the invention is based on a third embodiment of the invention and further characterized in that the amplifier apparatus has a differential amplifier configured to amplify the input signal and an output amplifier having a transistor and a capacitive device. The transistor outputs the signal from the differential amplifier to the output terminal. The capacitive device is connected between the gate of the transistor and the output terminal. The boost circuit supplies the negative or positive constant current to the capacitive device that is the given part to thereby electrically charge or discharge the capacitive device. In this way, the output responsiveness of the amplifier apparatus is enhanced.

A fifth embodiment of the invention is based on the third embodiment and further characterized in that the amplifier apparatus has a differential amplifier configured to amplify the input signal and an output amplifier having a transistor outputting a signal from the differential amplifier to the output terminal. The boost circuit supplies the negative or positive constant current to the output terminal that is the given part. In this way, the output responsiveness of the amplifier apparatus is enhanced.

A sixth embodiment of the invention is based on the third embodiment and further characterized in that the amplifier apparatus has a differential amplifier configured to amplify the input signal and an output amplifier having a transistor outputting the signal from the differential amplifier to the output terminal. The boost circuit supplies the constant current that is positive to a bias current supply node which is the given portion. Thus, the bias current for the differential amplifier is increased. In this way, the output responsiveness of the amplifier apparatus is enhanced.

A seventh embodiment of the invention is based on the fourth embodiment and further characterized in that the output amplifier includes a first transistor and a second transistor. The capacitive device includes a first capacitive element and a second capacitive element. The first capacitive element is connected between the gate of the first transistor and the output terminal. The second capacitive element is connected between the gate of the second transistor and the output terminal. When the voltage of the input signal is higher than the voltage at the output terminal by more than the given value, the boost circuit electrically discharges one or both of the first and second capacitive elements. When the voltage of the input signal is lower than the voltage at the output terminal by more than the given value, the boost circuit electrically charges one or both of the first and second capacitive elements.

An eighth embodiment of the invention is based on the seventh embodiment and further characterized in that the boost circuit is designed as follows. A first current mirror circuit, the output of a third transistor, and the output of a fourth transistor are sequentially connected in series between the first and second potentials. The output of a fifth transistor, the output of a sixth transistor, and a second current mirror circuit are sequentially connected in series between the first and second potentials. The input signal is connected to the gate of the third transistor and to the gate of the sixth transistor. The output terminal is connected to the gate of the fourth transistor and to the gate of the fifth transistor.

According to the first embodiment of the invention, there are provided the amplifier apparatus configured to amplify the input signal and outputting the amplified signal from the output terminal and the boost circuit for enhancing the output responsiveness of the amplifier apparatus by supplying the positive or negative constant current to the given portion of the amplifier apparatus when the difference between the voltage of the input signal and the voltage at the output terminal is greater than the given value. Consequently, the amplification circuit can be offered which has suppressed power consumption and whose stability is not impaired.

According to the second embodiment of the invention, the driver circuit is used for a liquid crystal display, the driver circuit operating to output the driver signal for driving each pixel formed in the display portion configured to display an image. The driver circuit has (A) the amplifier apparatus configured to amplify the input signal and outputting the amplified signal from the output terminal and (B) the boost circuit which, when the difference between the voltage of the input signal and the voltage at the output terminal is greater than the given value, supplies the positive or negative constant electrical current to the given part of the amplifier apparatus, thus enhancing the output responsiveness of the amplifier apparatus. Consequently, the driver circuit can be offered which is used for a liquid crystal display and whose stability is not impaired while suppressing the power consumption.

According to the third embodiment of the invention, the liquid crystal display has the driver circuit for outputting the driver signal for driving each pixel formed in the display portion configured to display an image. The driver circuit has the amplifier apparatus and the boost circuit. The amplifier apparatus amplifies the input signal and outputs the amplified signal from the output terminal. The boost circuit supplies the positive or negative constant current to the given part of the amplifier apparatus when the difference between the voltage of the input signal and the voltage at the output terminal is greater than the given value, thus enhancing the output responsiveness of the amplifier apparatus. Consequently, the liquid crystal display can be offered whose stability is prevented from being impaired while suppressing the power consumption.

According to the fourth embodiment of the invention, the amplifier apparatus has the differential amplifier configured to amplify the input signal and the output amplifier having the transistor and the capacitive device. The transistor outputs the signal from the differential amplifier to the output terminal. The capacitive device is connected between the gate of the transistor and the output terminal. The boost circuit supplies the negative or positive constant current to the capacitive device that is the given part, thus electrically charging or discharging the capacitive device. In this way, the output responsiveness of the amplifier apparatus is enhanced. Consequently, the amplification circuit can be offered which prevents the stability from being impaired while suppressing the power consumption.

According to the fifth embodiment of the invention, the amplifier has the differential amplifier configured to amplify the input signal and the output amplifier having the transistor outputting the signal from the differential amplifier to the output terminal. The boost circuit supplies the negative or positive constant current to the output terminal that is the given part to thereby enhance the output responsiveness of the amplifier apparatus. Consequently, the amplification circuit can be offered which prevents the stability from being impaired while suppressing the power consumption.

According to the sixth embodiment of the invention, the amplifier apparatus has the differential amplifier configured to amplify the input signal and the output amplifier having the transistor outputting the signal from the differential amplifier to the output terminal. The boost circuit increases the bias current for the differential amplifier by supplying the positive constant current to the bias current supply node that is the given part. In this way, the output responsiveness of the amplifier apparatus is enhanced. Consequently, the amplification circuit can be offered whose stability is prevented from being impaired while suppressing the power consumption.

According to the seventh embodiment of the invention, the output amplifier includes the first and second transistors. The capacitive device includes the first and second capacitive elements. The first capacitive element is connected between the gate of the first transistor and the output terminal. The second capacitive element is connected between the gate of the second transistor and the output terminal. When the voltage of the input signal is higher than the voltage at the output terminal by more than the given value, the boost circuit electrically discharges one or both of the first and second capacitive elements. When the voltage of the input signal is lower than the voltage at the output terminal by more than the given value, the boost circuit electrically charges one or both of the first and second capacitive elements. Consequently, the amplification circuit can be offered whose stability is not impaired while suppressing the power consumption.

According to the eighth embodiment of the invention, the boost circuit is designed as follows. (A) The first current mirror circuit, the output of the third transistor, and the output of the fourth transistor are sequentially connected in series between the first and second potentials. (B) The output of the fifth transistor, the output of the sixth transistor, and the second current mirror circuit are sequentially connected in series between the first and second potentials. (C) The input signal is connected to the gate of the third transistor and to the gate of the sixth transistor. (D) The output terminal is connected to the gate of the fourth transistor and to the gate of the fifth transistor. Consequently, the boost circuit with simple configuration can be offered.

DESCRIPTION OF THE PREFERRED EMBODIMENTS

The configurations and operation of liquid crystal displays according to embodiments of the invention are hereinafter described in turn.

First Embodiment

Figure 1:
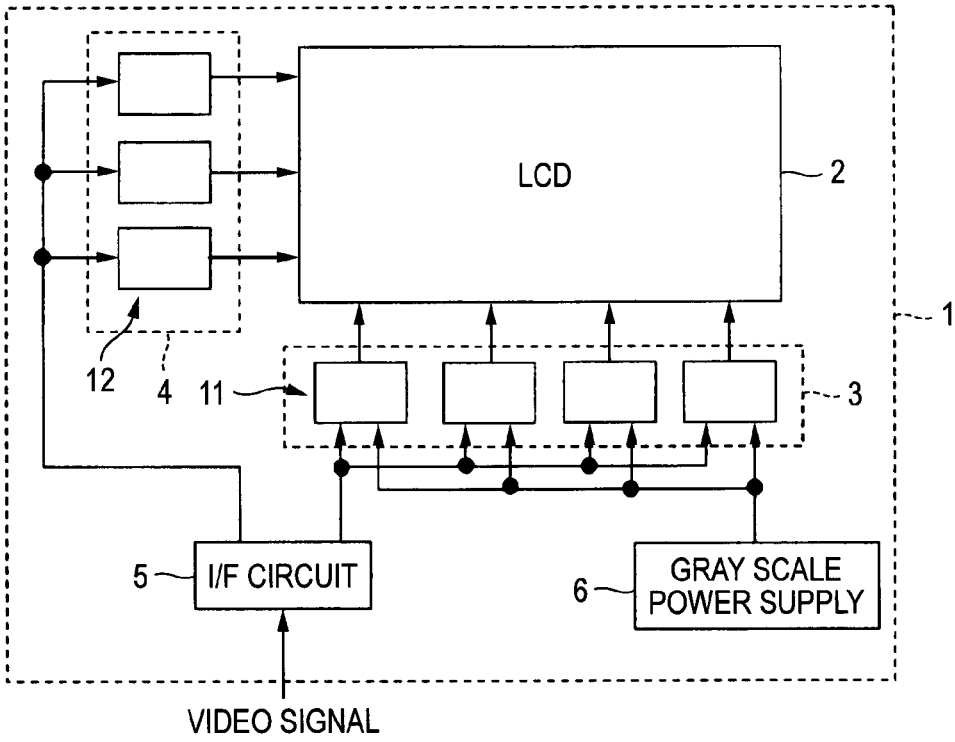
FIG. 1 is a schematic block diagram of a liquid crystal display associated with one embodiment of the invention.

First, the configuration of a liquid crystal display, indicated by numeral 1, is described by referring to FIG. 1, which is a schematic block diagram of the liquid crystal display 1.

As shown in FIG. 1, the liquid crystal display 1 has a liquid crystal display portion 2, a horizontal driver circuit 3, a vertical driver circuit 4, an interface (I/F) circuit 5, and a gray scale power supply 6. The horizontal driver circuit 3 has a plurality of source driver circuits 11. The vertical driver circuit 4 has a plurality of gate driver circuits 12. The source driver circuits 11 correspond to a driver circuit for the liquid crystal display.

The display portion 2 of the LCD has a semiconductor substrate, a counter substrate, and a liquid crystal material sealed between the substrates. Transparent pixel electrodes and TFTs are arranged on the semiconductor substrate. One transparent electrode is formed on the whole display portion of the counter substrate. A voltage corresponding to the pixel gray scale is applied to each pixel electrode by controlling the TFTs each having a switching function to produce a potential difference between each pixel electrode and the electrode on the counter electrode. Consequently, the transmittance of the liquid crystal material is varied. As a result, an image is displayed.

In the display portion 2 of the LCD, the pixel electrodes are arranged in the vertical and horizontal directions like a matrix (rows and columns). Plural data lines for applying a gray scale voltage to each pixel electrode and scanning lines for applying a control signal for switching the TFTs are arranged on the semiconductor substrate in the liquid crystal display portion 2. The pixel electrodes arranged in the vertical direction are connected with the data lines.

The gray level voltage is applied via the data lines to each pixel electrode by a driver signal delivered from the corresponding source driver circuit 11. That is, the gray scale voltage is applied to all the pixel electrodes connected with the data lines during one frame period for image display by the driver signal. The pixel electrodes are driven. An image is displayed on the display portion 2 of the LCD.

The source driver circuit 11 outputs the driver signal to the data lines while switching the horizontal lines sequentially in response to the output signal from the interface circuit 5.

Figure 2:
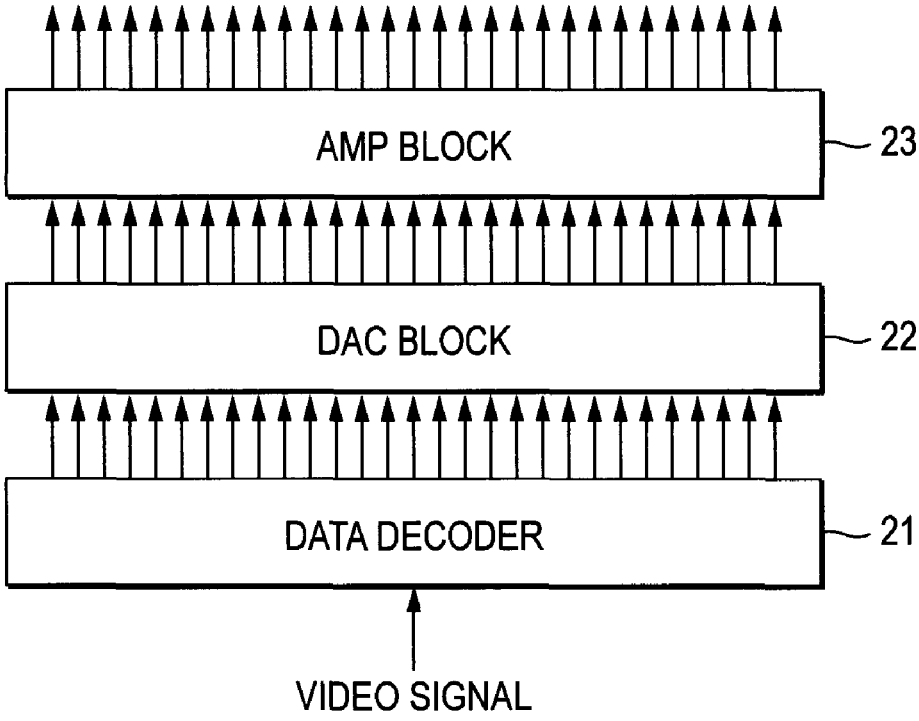
FIG. 2 is a schematic block diagram of a source driver.

As shown in FIG. 2, each source driver circuit 11 has a decoder circuit 21, a digital-analog converter circuit block (DAC block) 22, and an amplification circuit block (AMP block) 23. The decoder circuit 21 decodes a serial image signal supplied from the interface circuit 5 and outputs a digital signal for driving each vertical line of the display portion 2 of the LCD. The DAC block 22 converts the digital driving signals into analog signals for driving. The AMP block 23 amplifies the current of the analog signal for driving for each vertical line that is outputted from the DAC block 22, and outputs the amplified current signal to the liquid crystal display portion 2.

The gate driver circuits 12 act to output control signals sequentially to switch the TFTs for each horizontal line. Thus, an image is displayed on the liquid crystal display portion 2 in response to the driver signals delivered from the source driver circuits 11 while sequentially turning on the horizontal lines one at a time.

The interface circuit 5 enters video signals (e.g., vertical start signal, vertical clock, enable signal, vertical start signal, horizontal clock, serial image data sets R, G, B, and reference voltage) supplied from the outside. The interface circuit 5 supplies various signals (i.e., serial image data signal, horizontal start signal that is a timing pulse signal for horizontal driving, horizontal clock, and output enable signal) to each of the source driver circuits 11. Furthermore, the interface circuit supplies the timing pulse signals for vertical driving (e.g., enable signal, vertical clock, and vertical start signal) to each of the gate driver circuits 12.

An amplification circuit 30 forming the amplification circuit block 23 is next described in detail with reference to some figures. An example of the configuration of the amplification circuit 30 is schematically shown in the block diagrams of FIGS. 3 and 4. The amplification circuit 30 is provided for each data line.

Figure 3:
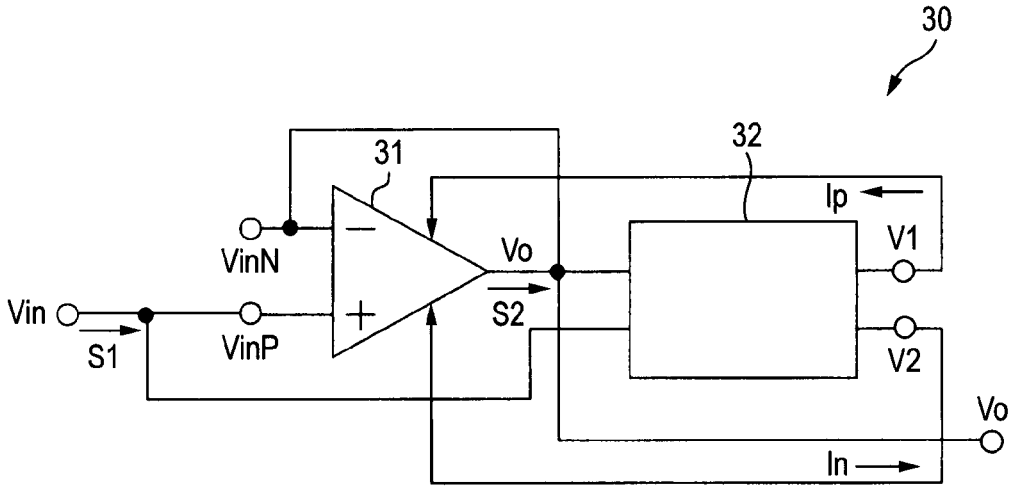
FIG. 3 is a schematic diagram of an amplification circuit.

As shown in FIG. 3, the amplification circuit 30 is made of an operational amplifier 31 and a booster circuit 32. An input terminal Vin is connected to the DAC block 22. An analog signal S1 that is outputted from the DAC block 22 and used for driving is entered to the input terminal Vin.

The operational amplifier 31 has a non-inverting input terminal VinP and an inverting input terminal VinN. The operational amplifier 31 operates to output a voltage corresponding to voltages applied to the input terminals VinP and VinN to the output terminal Vo. The data lines of the display portion 2 of the LCD are connected to the output terminal Vo. That is, capacitive loads are connected to the amplification circuit 30.

When the input terminal Vin and non-inverting input terminal VinP are connected and, at the same time, the non-inverting input terminal VinN and output terminal Vo are connected, the operational amplifier 31 operates as a voltage follower.

Meanwhile, the output terminal Vo and input terminal Vin are connected with the boost circuit 32. The input signal S1 from the DAC and the output signal S2 from the operational amplifier 31 are entered to the boost circuit. The boost circuit 32 further includes output terminals V1 and V2. An electrical current corresponding to the input signal S1 and output signal S2 is supplied to the operational amplifier 31 from the output terminal V1 or V2.

Figure 4:
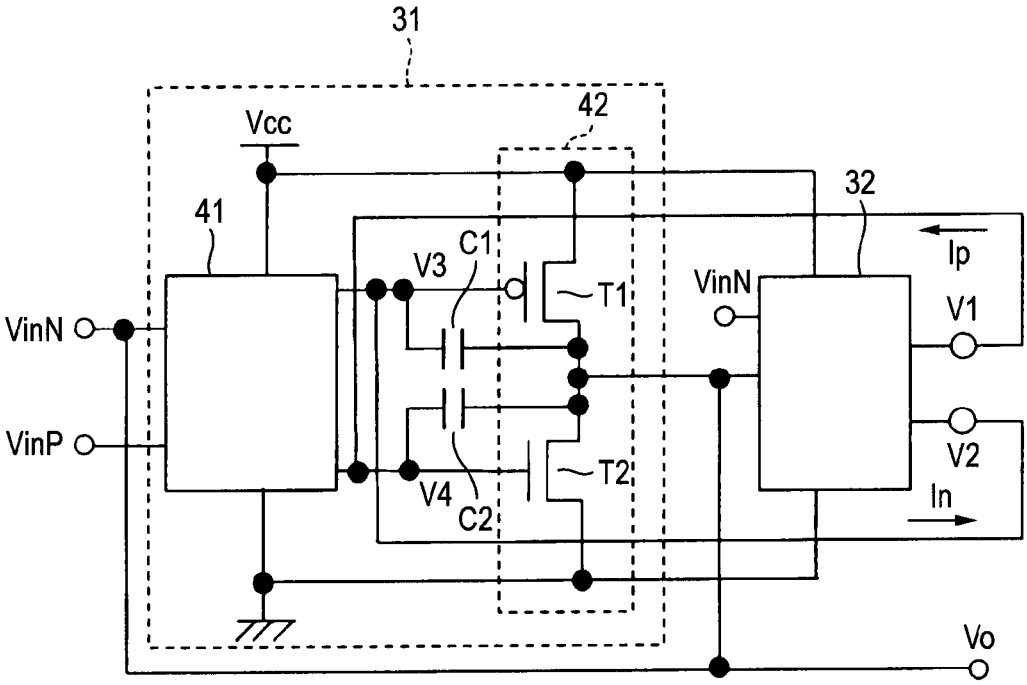
FIG. 4 is a schematic diagram of another amplification circuit.

The operational amplifier 31 includes a differential amplifier 41 and an output amplifier 42, for example, as shown in FIG. 4. The output amplifier 42 includes a PMOS transistor T1 and an NMOS transistor T2 and has a first capacitive element C1 and a second capacitive element C2. The PMOS transistor T1 and NMOS transistor T2 correspond to first and second transistors, respectively.

The differential amplifier 41 has the non-inverting input terminal VinP and inverting input terminal VinN as its input terminals as described previously. In response to the voltage of the input signal S1, the differential amplifier produces output voltages V3 and V4.

The gate of the PMOS transistor T1 is connected to one output terminal of the differential amplifier 41, and the transistor T1 operates according to the output voltage V3. The gate of the NMOS transistor T2 is connected to the other output terminal of the differential amplifier 41, and the transistor T2 operates according to the output voltage V4.

The source of the PMOS transistor T1 is connected to a first potential (potential Vcc in the present embodiment). The drain of the PMOS transistor T1 is connected to the output terminal Vo. The source of the NMOS transistor T2 is connected to a second potential (ground potential in the present embodiment). The drain of the NMOS transistor T2 is connected to the output terminal Vo.

The first capacitive element C1 is connected between the gate and drain of the PMOS transistor T1 to provide phase compensation. Similarly, the second capacitive element C2 is connected between the gate and drain of the NMOS transistor T2 to provide phase compensation.

The output terminal V1 of the boost circuit 32 is connected to the gate of the NMOS transistor T2, while the output terminal V2 is connected to the gate of the PMOS transistor T1.

Since the amplification circuit 30 is designed as described so far, the amplification circuit 30 operates in the manner described below.

As an example, if the input signal S1 varies quickly by an amount greater than a given potential difference (e.g., 1.2 V) because of switching of the horizontal line of the pixel electrodes to be displayed, the voltage at the non-inverting input terminal VinP becomes greater than the voltage at the inverting input terminal VinN (voltage at the output terminal Vo) by more than the given potential difference at the instant when the variation occurs. Therefore, the differential amplifier 41 operates to pull down the output voltage V3 so as to eliminate the voltage difference.

If the boost circuit 32 is not present, when the differential amplifier 41 tries to pull down the output voltage V3, the first capacitive element C1 is electrically discharged until the desired voltage is reached. Therefore, the PMOS transistor T1 may not follow quickly.

On the other hand, in the amplification circuit 30 according to the present embodiment, there is provided the boost circuit 32. Therefore, if the input signal S1 increases quickly by more than the given potential difference, the input signal S1 and output signal S2 are compared in terms of voltage in the boost circuit 32. Since there is a voltage difference greater than the given voltage difference, electrical current In flows into the boost circuit 32 from the output terminal V2. The current In quickly discharges the first capacitive element C1. Hence, the PMOS transistor T1 can quickly follow the variation of the input signal S1.

Conversely, if the input signal S1 quickly decreases by more than the given potential difference, the voltage at the non-inverting input terminal VinP becomes smaller than the voltage at the inverting input terminal VinN (voltage at the output terminal Vo) at the instant when the variation occurs, and the differential amplifier 41 operates to pull up the voltage at the output V4 so as to eliminate the voltage difference. If the boost circuit 32 does not exist, the differential amplifier 41 will try to pull up the output voltage V4. However, the second capacitive element C2 is electrically charged until the target voltage is reached. Therefore, the NMOS transistor T2 may not follow immediately.

Meanwhile, in the amplification circuit 30 according to the present embodiment, the boost circuit 32 is provided. Therefore, if the input signal S1 rapidly decreases by more than the given potential difference, the input signal S1 and the output signal S2 are compared in the boost circuit 32. Since there is the potential difference exceeding the given potential difference, electrical current Ip is outputted from the output terminal V1. Accordingly, the current Ip quickly charges the second capacitive element C2. The NMOS transistor T2 can be made to closely follow the variation of the input signal S1.

In this way, in the amplification circuit 30 according to the present embodiment, when there is more than the given potential difference between the voltage of the input signal S1 and the voltage at the output terminal Vo, if the capacitive elements C1 and C2 are present, the slew rate (output responsiveness) relative to the input signal S1 can be enhanced because there is the boost circuit for electrically charging or discharging the first capacitive element C1 and second capacitive element C2. That is, when the difference between the voltage of the input signal S1 and the voltage at the output terminal Vo is greater than a given value, the output responsiveness of the operational amplifier is enhanced by supplying a positive or negative constant electrical current to the capacitive elements C1 and C2 which are given parts.

Figure 5:
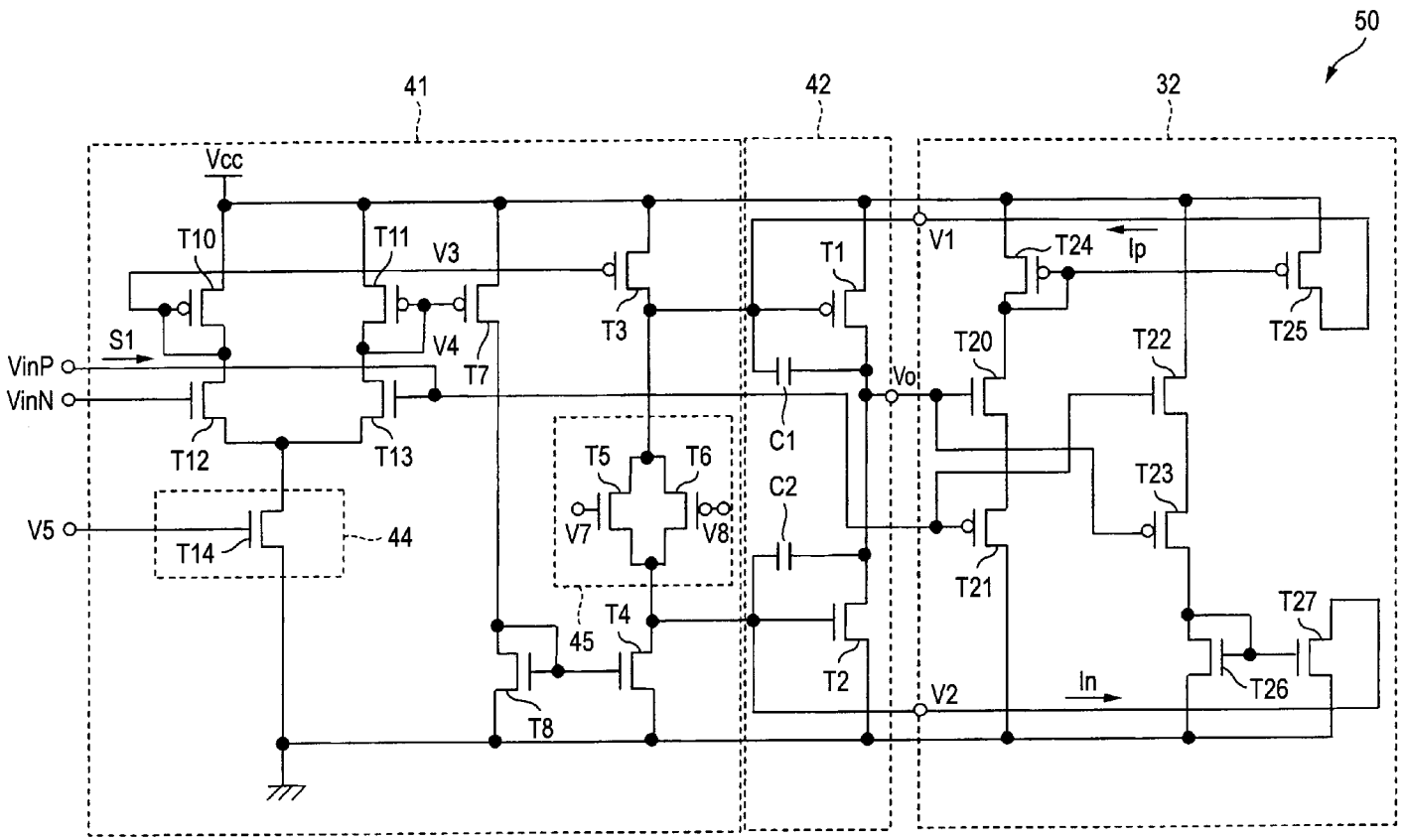
FIG. 5 is a circuit diagram particularly showing the configuration of an amplification circuit.

An amplification circuit 50 that is a specific example of the above-described amplification circuit is shown in FIG. 5. The structure of the amplification circuit 50 is described in detail below. Those components of the amplification circuit 50 which are similar in function with their respective counterparts of the amplification circuit 30 are indicated by the same reference numerals.

The amplification circuit 50 includes a differential amplifier 41, an output amplifier 42, and a booster circuit 32.

The differential amplifier 41 includes PMOS transistors T3, T6, T7, T10, T11 and NMOS transistors T4, T5, T8, T12-T14.

The sources of the PMOS transistors T10 and T11 are both connected to the first potential. The gate and drain of the PMOS transistor T10 are connected together. The drain of the transistor T10 is connected to the drain of the NMOS transistor T12. Meanwhile, with respect to the PMOS transistor T11, the gate is connected to the drain, which in turn is connected to the drain of the NMOS transistor T13.

The gate of the NMOS transistor T12 is connected to an inverting input terminal VinN. The gate of the NMOS transistor T13 is connected to a non-inverting input terminal VinP. The sources of the NMOS transistors T12 and T13 are connected together, and are also connected to a constant current circuit 44. The constant current circuit 44 is made of an NMOS transistor T14 and controlled by V5.

The gate of the PMOS transistor T7 is connected to the gate of the PMOS transistor T11. The PMOS transistors T7 and T11 together form a current mirror circuit. The source of the PMOS transistor T7 is connected to the first potential. The drain of the transistor T7 is connected with the drain of the NMOS transistor T8.

The source of the NMOS transistor T8 is connected to a second potential. The gate of the NMOS transistor T8 is connected to the drain of T8 and to the gate of the NMOS transistor T4. The NMOS transistors T8 and T4 together form a current mirror circuit. The source of the NMOS transistor T4 is connected to the second potential. The drain of the transistor T4 is connected to a bias application circuit 45 and to the gate of the NMOS transistor T2.

The bias application circuit 45 includes an NMOS transistor T5 and a PMOS transistor T6, and has a function of applying a bias to the PMOS transistor T1 and NMOS transistor T2. The bias can be controlled by V7 and V8.

The gate of the PMOS transistor T3 is connected to the gate of the PMOS transistor T10. The PMOS transistors T3 and T10 together form a current mirror circuit. The source of the PMOS transistor T3 is connected to the first potential. The drain of the transistor T3 is connected to the gate of the PMOS transistor T1 and to the bias application circuit 45.

The output amplifier 42 includes a PMOS transistor T1 and an NMOS transistor T2. A first capacitive element C1 is connected between the gate and drain of the PMOS transistor T1. A second capacitive element C2 is connected between the gate and drain of the NMOS transistor T2.

The gate of the PMOS transistor T1 is connected to the drain of the PMOS transistor T3. The source of the transistor T1 is connected to the first potential. The drain of the transistor T1 is connected to the output terminal Vo.

The gate of the NMOS transistor T2 is connected to the drain of the NMOS transistor T4. The source of T2 is connected to the second potential. The drain of T2 is connected to the output terminal Vo.

The boost circuit 32 includes PMOS transistors T21, T23, T24, T25 and NMOS transistors T20, T22, T26, T27.

The input terminal Vin is connected to the gate of the PMOS transistor T21 and to the gate of the NMOS transistor T22. The output terminal Vo is connected to the gate of the NMOS transistor T20 and to the gate of the PMOS transistor T23. The NMOS transistor T20 and PMOS transistor T21 correspond to third and fourth transistors, respectively. The NMOS transistors T22 and PMOS transistor T23 correspond to fifth and sixth transistors, respectively.

If the input signal S1 is smaller than the output signal S2 by more than Vgs×2 (hereinafter referred to as the given potential difference), the NMOS transistor T20 and PMOS transistor T21 are turned on, energizing the PMOS transistor T24. If the input signal S1 is greater than the output signal S2 by more than the given potential difference, the NMOS transistor T22 and PMOS transistor T23 are turned on, energizing the NMOS transistor T26. Where the difference between the input signal S1 and output signal S2 is more than the given potential difference in this way, these transistors are driven on.

The gate of the PMOS transistor T24 is connected to its drain and to the gate of the PMOS transistor T25. The PMOS transistors T24 and T25 together form a current mirror circuit. This current mirror circuit corresponds to a first current mirror circuit.

The sources of the PMOS transistors T24 and T25 are connected to the first potential. The drain of the PMOS transistor T24 is connected to the drain of the NMOS transistor T20. The drain of the PMOS transistor T25 is connected to the gate of the PMOS transistor T1.

In this way, the first current mirror circuit, the output of the third transistor, and the output of the fourth transistor are connected sequentially in series between the first and second potentials.

The gate of the NMOS transistor T26 is connected to its drain and to the gate of the NMOS transistor T27. The NMOS transistors T26 and T27 together form a current mirror circuit. This current mirror circuit corresponds to a second current mirror circuit.

The sources of the NMOS transistors T26 and T27 are connected to the second potential. The drain of the NMOS transistor T26 is connected to the drain of the PMOS transistor T23. The drain of the NMOS transistor T27 is connected to the gate of the NMOS transistor T2.

In this way, the output of the fifth transistor, the output of the sixth transistor, and the second current mirror circuit are sequentially connected in series between the first and second potentials.

Since the amplification circuit 50 is constructed in this way, the amplification circuit 50 operates in the manner described below.

First, the horizontal line of the pixel electrodes to be displayed is switched. If the voltage of the input signal S1 increases by more than the given potential difference, for example, the voltage at the non-inverting input terminal VinP becomes greater than the voltage at the inverting input terminal VinN (voltage at the output terminal Vo) by more than the given potential difference at the instant when the variation occurs. The differential amplifier 41 operates to pull down the voltages at the output terminals V1 and V2 so as to eliminate the potential difference.

In the boost circuit 32, the voltage of the input signal S1 and the voltage at the output terminal Vo are compared. Since there is more than the given potential difference, electrical current flows into the outputs of the NMOS transistor T22 and PMOS transistor T23. Electrical current In flows in from the output terminal V2 via the second current mirror circuit. Accordingly, the first capacitive element C1 and second capacitive element C2 are quickly discharged by the current In. The PMOS transistor T1 and NMOS transistor T2 quickly respond to the variation of the input signal S1.

Conversely, if the voltage of the input signal S1 decreases by more than the given potential difference, the voltage at the non-inverting input terminal VinP becomes smaller than the voltage (voltage at the output terminal Vo) at the inverting input terminal VinN by more than the given potential difference at the instant when the variation occurs, and the differential amplifier 41 operates to pull up the voltages at the output terminals V1 and V2 so as to eliminate the voltage difference.

Furthermore, the input signal S1 and output signal S2 are compared in the boost circuit 32. Since there is a potential difference greater than the given potential difference, electrical current flows into the outputs of the NMOS transistor T20 and PMOS transistor T21. Electrical current Ip is produced from the output terminal V1 via the first current mirror circuit. Accordingly, the current Ip quickly charges the first capacitive element C1 and second capacitive element C2. The PMOS transistor T1 and NMOS transistor T2 quickly respond to the variation of the input signal S1.

In this way, in the amplification circuit 50 according to the present embodiment, when the potential difference between the voltage of the input signal S1 and the voltage at the output terminal Vo is greater than the given value (given potential difference), the slew rate relative to the input signal S1 can be enhanced without impairing the stability because there is the boost circuit for electrically charging or discharging the first capacitive element C1 and second capacitive element C2, in the same way as in the amplification circuit 30. Thus, the output responsiveness of the amplification circuit 50 is enhanced by supplying the positive or negative constant current to the capacitive elements C1 and C2 that are given parts by means of the boost circuit 32 when the difference between the voltage at the input signal S1 and the voltage at the output terminal Vo is more than the given value. The boost circuit 32 operates only when the potential difference is greater than the given potential difference and does not operate when the difference is smaller than the given potential difference. Consequently, wasteful power consumption can be suppressed, resulting in high efficiency. Since the circuit operates only when the difference is equal to or greater than the given potential difference and does not operate when the difference is less than the given potential difference, the operation of the boost circuit 32 is automatically stopped when the voltage difference decreases down to zero. Any external signal for controlling the boost circuit is not necessary.

Second Embodiment

A liquid crystal display according to a second embodiment of the invention is next described in detail with reference to some figures. In the first embodiment, the output amplifier of the amplification circuit is described as an AB class output stage. In the present second embodiment, the output amplifier described as an A class output stage.

Figure 6:
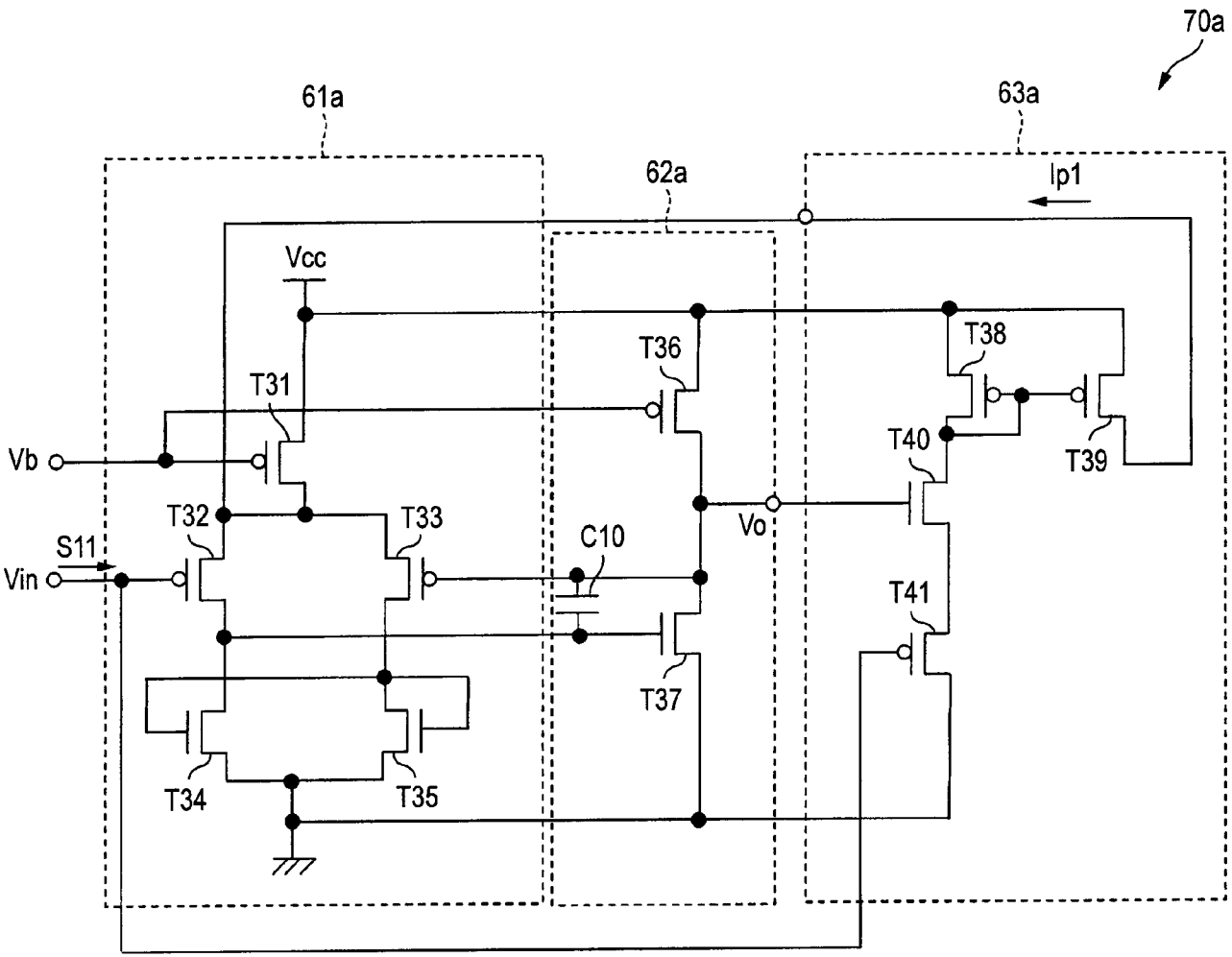
FIG. 6 is a circuit diagram particularly showing the configuration of another amplification circuit.

In FIG. 6, an amplification circuit 70*a* includes a differential amplifier 61*a*, an output amplifier 62*a*, and a boost circuit 63*a*.

The differential amplifier 61*a* includes PMOS transistors T31-T33 and NMOS transistors T34 and T35.

The PMOS transistor T31 operates as a constant current circuit. Its source is connected to a first potential. Its drain is connected to the sources of the PMOS transistors T32 and T33. The gate of the PMOS transistor T31 is connected to Vb. The constant current circuit is controlled by Vb.

The drain of the PMOS transistor T32 is connected to the drain of the NMOS transistor T34. The drain of the PMOS transistor T33 is connected to the drain of the NMOS transistor T35. The sources of the NMOS transistors T34 and T35 are connected together, and are connected to a second potential. The gates of the NMOS transistors T34 and T35 are both connected to the drain of the NMOS transistor T35. The gate of the PMOS transistor T32 is connected to the input terminal Vin.

The output amplifier 62*a* includes a PMOS transistor T36 and an NMOS transistor T37. A capacitive element C10 is connected between the gate and drain of the NMOS transistor T37.

The gate of the NMOS transistor T37 is connected to the drain of the PMOS transistor T32 and to the drain of the NMOS transistor T34. The source of the transistor T37 is connected to the first potential, and the drain is connected to the output terminal Vo.

The PMOS transistor T36 operates as a constant current circuit. The source of the transistor T36 is connected to the first potential. The drain of the transistor T36 is connected to the output terminal Vo. The gate of the PMOS transistor T36 is connected to Vb. The constant current circuit is controlled by Vb.

The boost circuit 63*a* includes PMOS transistors T38, T39, T41 and an NMOS transistor T40.

The input terminal Vin is connected to the gate of the PMOS transistor T41. The output terminal Vo is connected to the gate of the NMOS transistor T40.

When the voltage of the input signal S11 is smaller than the voltage at the output terminal Vo by more than Vgs×2 (hereinafter referred to as the given potential difference), the NMOS transistor T40 and PMOS transistor T41 are turned on, energizing the PMOS transistor T38. When the difference between the voltage of the input signal S11 and the voltage at the output terminal Vo is greater than the given potential difference in this way, these transistors operate.

The gate of the PMOS transistor T38 is connected to its drain and to the gate of the PMOS transistor T39. The PMOS transistors T38 and T39 together form a first current mirror circuit.

The sources of the PMOS transistors T38 and T39 are connected to the first potential. The drain of the PMOS transistor T38 is connected to the drain of the NMOS transistor T40.

The first current mirror circuit, NMOS transistor T40, and PMOS transistor T41 are sequentially connected in series between the first and second potentials in this way.

Because the amplification circuit 70*a* is constructed as described so far, the amplification circuit 70*a* operates in the manner described below.

First, the horizontal line of the pixel electrodes to be displayed is switched. If the voltage of the input signal S11 decreases by more than the given potential difference, for example, the voltage of the input signal S11 becomes smaller than the voltage at the output terminal Vo by more than the given potential difference at the instant when the variation occurs. The differential amplifier 61*a* operates to pull down the voltage at the output terminal Vo so as to eliminate the potential difference.

The voltage of the input signal S11 and the voltage at the output terminal Vo are compared in the boost circuit 63*a*. Since the difference is greater than the given potential difference, electrical current flows into the outputs of the NMOS transistor T40 and PMOS transistor T41. Electrical current Ip1 flows into the first current mirror circuit. The current Ip1 is supplied to the drain of the PMOS transistor T31 that is a bias current node for the differential amplifier 61*a*, and the bias current for the differential amplifier 61*a* increases. Therefore, the capacitive element C10 is quickly discharged. The NMOS transistor T37 quickly responds to the voltage variation of the input signal S11.

In this way, in the amplification circuit 70*a* according to the present embodiment, when the voltage of the input signal S11 becomes smaller than the voltage at the output terminal Vo by more than the given potential difference, the slew rate relative to the input signal S11 can be enhanced without impairing the stability because there is the boost circuit 63*a* for quickly electrically charging the capacitive element C10. The boost circuit 63*a* operates only when the potential difference is equal to or greater than the given potential difference and does not operate when the difference is less than the given potential difference. Consequently, wasteful power consumption can be suppressed, resulting in high efficiency. Since the circuit operates only when the difference is equal to or greater than the given potential difference and does not operate when the difference is less than the given potential difference, the operation of the boost circuit is automatically stopped when the voltage difference decreases down to zero. Any external signal for controlling the boost circuit 63*a* is not necessary.

Figure 7:
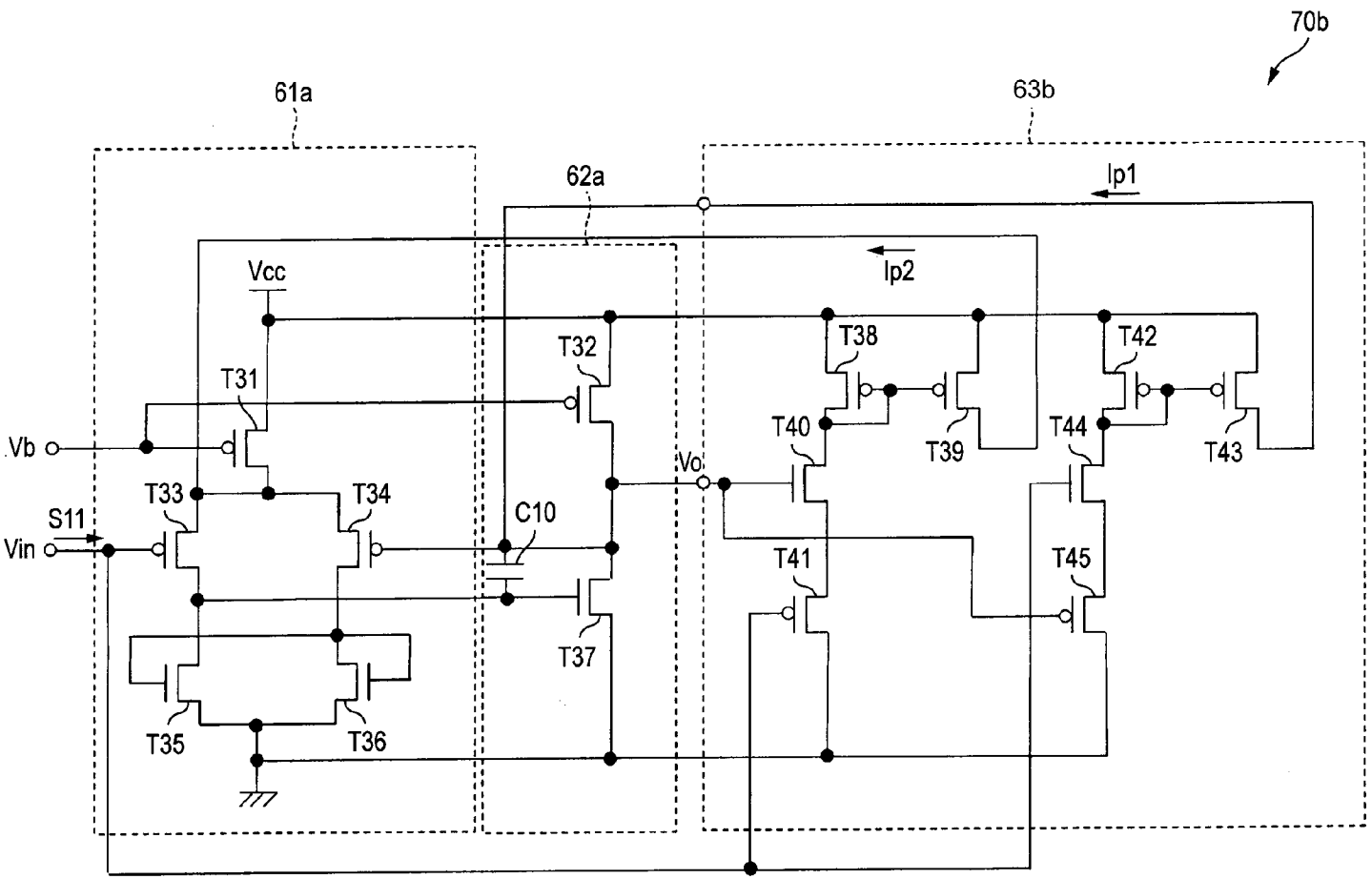
FIG. 7 is a circuit diagram particularly showing the configuration of a further amplification circuit.
Figure 8:
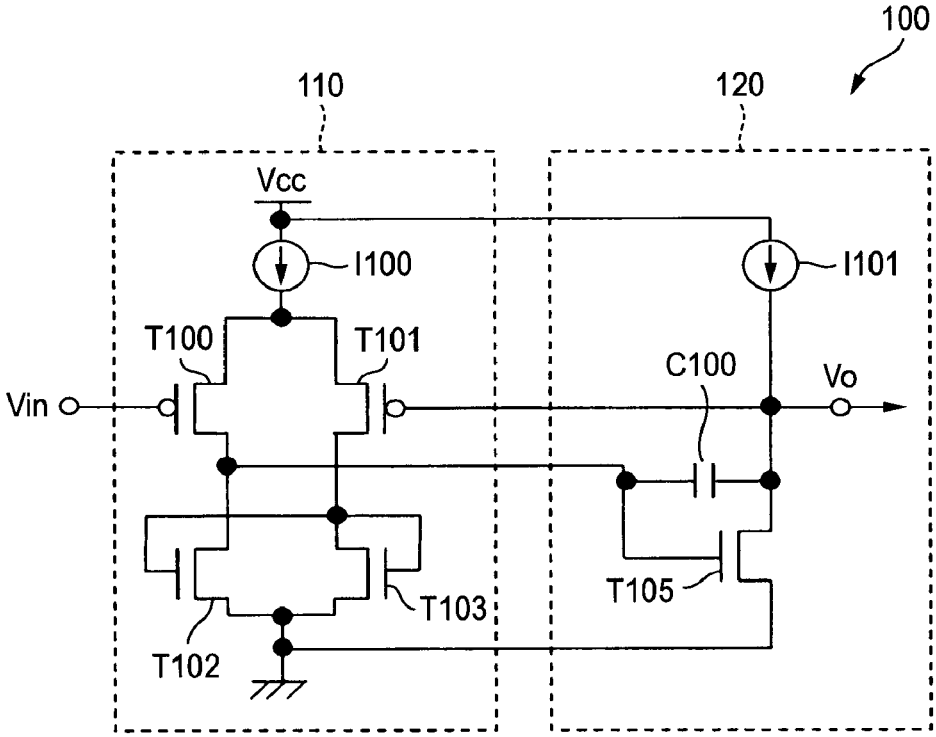
FIG. 8 PRIOR ART
FIG. 8 is a circuit diagram of a related art amplification circuit.

The amplification circuit 70*a* operates when the voltage of the input signal S11 becomes smaller than the voltage at the output terminal Vo by more than the given potential difference. By constructing an amplification circuit 70*b* as shown below, the circuit can be operated also when the voltage of the input signal S11 becomes greater than the voltage at the output terminal Vo by more than the given potential difference. FIG. 7 shows the configuration of the amplification circuit 70*b*.

As shown in FIG. 7, the boost circuit 63*a* of the amplification circuit 70*b* has PMOS transistors T42, T43, T45 and an NMOS transistor T44, in addition to the configuration of the boost circuit 63*a*. Configurations and operation of other transistors in the boost circuit 63*a* have been already described and so their description is omitted here.

The input terminal Vin is connected to the gate of the NMOS transistor T44. The output terminal Vo is connected to the gate of the PMOS transistor T45.

If the voltage of the input signal S11 is greater than the voltage at the output terminal Vo by more than Vgs×2 (hereinafter referred to as the given potential difference), the NMOS transistor T44 and PMOS transistor T45 are turned on, energizing the PMOS transistor T42. When the difference between the voltage of the input signal S11 and the voltage at the output terminal Vo is greater than the given potential difference, these transistors are driven on.

The gate of the PMOS transistor T42 is connected to its drain and to the gate of the PMOS transistor T43. The PMOS transistors T42 and T43 together form a second current mirror circuit.

The sources of the PMOS transistors T42 and T43 are connected to the first potential. The drain of the PMOS transistor T42 is connected to the drain of the NMOS transistor T44.

The second current mirror circuit, NMOS transistor T44, and PMOS transistor T45 are sequentially connected in series between the first and second potentials in this way.

Since the amplification circuit 70*b* is constructed in this way, the amplification circuit 70*b* operates in the manner described below.

First, the horizontal line of the pixel electrodes to be displayed is switched. If the voltage of the input signal S11 increases by more than the given potential difference, for example, the voltage of the input signal S11 becomes greater than the voltage at the output terminal Vo by more than the given potential difference at the instant when the variation occurs. The differential amplifier 61*a* operates to pull up the voltage at the output terminal Vo so as to eliminate the potential difference.

The voltage of the input signal S11 and the voltage at the output terminal Vo are compared in the boost circuit 63*b*. Since the difference is greater than the given potential difference, electrical current flows into the outputs of the NMOS transistor T44 and PMOS transistor T45. Electrical current Ip2 flows into the output terminal Vo from the second current mirror circuit. The current Ip2 can quickly increase the output voltage Vo.

In this way, in the amplification circuit 70*b* according to the present embodiment, when the voltage of the input signal S11 becomes smaller than the voltage at the output terminal Vo by more than the given potential difference, the capacitive element C10 is quickly charged. When the voltage at the input terminal Vin becomes greater than the voltage at the output terminal Vo by more than the given potential difference, the slew rate relative to the input signal S11 can be enhanced without impairing the stability because the amplification circuit has the boost circuit 63*b* for supplying electrical current to the output terminal Vo. That is, when the difference between the voltage of the input signal S11 and the voltage at the output voltage Vo is greater than the given value, the output responsiveness of the amplification circuit 70*b* can be enhanced by supplying constant electrical currents Ip1 and Ip2 to the capacitive element C10 that is a given part and to the input terminal Vo by means of the boost circuit 63*b*. The boost circuit 63*b* operates only when the potential difference is greater than the given potential difference and does not operate when the difference is smaller than the given potential difference. Consequently, wasteful power consumption can be suppressed, resulting in high efficiency. Since the circuit operates only when the difference is equal to or greater than the given potential difference and does not operate when the difference is less than the given potential difference, the operation of the boost circuit 63*b* is automatically stopped when the voltage difference decreases down to zero. Any external signal for controlling the boost circuit 63*b* is not necessary.

It should be understood by those skilled in the art that various modifications, combinations, sub-combinations and alterations may occur depending on design requirements and other factors insofar as they are within the scope of the appended claims or the equivalents thereof.

What is claimed is:

1. An amplification circuit comprising:

an amplifier apparatus configured to amplify an input signal and output the amplified signal from an output terminal, the amplifier apparatus comprising an operational amplifier including a differential amplifier receiving the input signal and an output amplifier configured to amplify an output of the differential amplifier and provide an output signal at the output terminal, the output amplifier having a first capacitive element and a second capacitive element; and a boost circuit connected to the differential amplifier and the output amplifier, and configured to compare a voltage of the input signal and a voltage at the output terminal with respect to a given value, the boost circuit being configured to supply a positive or negative constant electrical current to at least one of the first capacitive element and the second capacitive element of the amplifier apparatus, wherein, the boost circuit is configured to electrically discharge one or both of the first and second capacitive elements when the voltage of the input signal is higher than the voltage at the output terminal by more than the given value, and the boost circuit is configured to electrically charge one or both of the first and second capacitive elements when the voltage of the input signal is lower than the voltage at the output terminal by more than the given value.

2. The amplification circuit according to claim 1, wherein the operational amplifier includes a non-inverting input terminal and an inverting input terminal that receives input voltages to generate an output voltage through an output terminal.

3. The amplification circuit according to claim 2, wherein the operational amplifier includes a PMOS transistor, a NMOS transistor, the first capacitive element and the second capacitive element, the first capacitive element is connected between a gate and drain of the PMOS transistor, the second capacitive element is connected between the gate and drain of the NMOS transistor.

4. The amplification circuit according to claim 3, wherein a gate of the PMOS transistor is connected to an output terminal of the differential amplifier, the gate of the NMOS transistor is connected to another output terminal of the differential amplifier, a first output terminal of the boost circuit is connected to the gate of the NMOS transistor, a second output terminal of the boost circuit is connected to the gate of the PMOS transistor.

5. A driver circuit for a liquid crystal display, the driver circuit being operable to output a driver signal for driving each pixel formed in a display portion of the LCD for displaying an image, the driver circuit comprising:

an amplifier apparatus configured to amplify an input signal and output the amplified signal from an output terminal, the amplifier apparatus being an operational amplifier including a differential amplifier and an output amplifier, the output amplifier having a first capacitive element and a second capacitive element, data lines of the display portion are connected to the output terminal; and a boost circuit configured to compare a voltage of the input signal and a voltage at the output terminal with respect to a given value, the boost circuit being configured to supply a positive or negative constant electrical current to at least one of the first capacitive element and the second capacitive element of the amplifier apparatus, the driver circuit is provided for each data line of the display portion of the LCD, wherein, the boost circuit is configured to electrically discharge one or both of the first and second capacitive elements when the voltage of the input signal is higher than the voltage at the output terminal by more than the given value, and the boost circuit is configured to electrically charge one or both of the first and second capacitive elements when the voltage of the input signal is lower than the voltage at the output terminal by more than the given value.

6. The driver circuit according to claim 5, wherein the operational amplifier includes a non-inverting input terminal and an inverting input terminal that receives input voltages to generate an output voltage through the output terminal.

7. The driver circuit according to claim 6, the operational amplifier includes a PMOS transistor, an NMOS transistor, the first capacitive element and the second capacitive element, the first capacitive element is connected between a gate and drain of the PMOS transistor, the second capacitive element is connected between the gate and drain of the NMOS transistor.

8. The driver circuit according to claim 7, wherein a gate of the PMOS transistor is connected to an output terminal of the differential amplifier, the gate of the NMOS transistor is connected to another output terminal of the differential amplifier, a first output terminal of the boost circuit is connected to the gate of the NMOS transistor, a second output terminal of the boost circuit is connected to the gate of the PMOS transistor.

9. A display device having a driver circuit for outputting a driver signal used to drive each vertical pixel formed in a display portion configured to display an image, wherein, the driver circuit has:

an amplifier apparatus configured to amplify an input signal and output the amplified signal from an output terminal, the amplifier apparatus being an operational amplifier including a differential amplifier and an output amplifier, the output amplifier having a capacitive device; and a boost circuit configured to compare a voltage of the input signal and a voltage at the output terminal with respect to a given value, the boost circuit being configured to supply a positive or negative constant electrical current to at least the capacitive device, and the boost circuit is configured to electrically discharge the capacitive device when the voltage of the input signal is higher than the voltage at the output terminal by more than the given value, and the boost circuit is configured to electrically charge the capacitive device when the voltage of the input signal is lower than the voltage at the output terminal by more than the given value.

10. The display device as set forth in claim 9, wherein:

the differential amplifier is configured to amplify the input signal; and the output amplifier has a transistor and the capacitive device, the transistor outputting a signal from the differential amplifier to the output terminal, and the capacitive device being connected between a gate of the transistor and the output terminal.

11. The display device as set forth in claim 10, wherein:

the output amplifier has a transistor configured to output a signal from the differential amplifier to the output terminal, and the boost circuit is configured to supply the constant current that is positive to a bias current supply node connected to the differential amplifier to increase a bias current for the differential amplifier, thus enhancing the output responsiveness of the amplifier apparatus.

12. The display device as set forth in claim 10, wherein:

the output amplifier includes a first transistor and a second transistor, the capacitive device includes a first capacitive element and a second capacitive element, the first capacitive element being connected between a gate of the first transistor and the output terminal, the second capacitive element being connected between a gate of the second transistor and the output terminal.

13. The display device as set forth in claim 12, wherein in the boost circuit, a first current mirror circuit, an output of a third transistor, and an output of a fourth transistor are sequentially connected in series between first and second potentials, an output of a fifth transistor, an output of a sixth transistor, and a second current mirror circuit are sequentially connected in series between the first and second potentials, the input signal is connected to a gate of the third transistor and to a gate of the sixth transistor, and the output terminal is connected to a gate of the fourth transistor and to a gate of the fifth transistor.

14. The display device as set forth in claim 9, wherein the boost circuit only operates when the given value is exceeded.

* * * * *